United States Patent [19]

Hufstetler et al.

[11] Patent Number: 4,761,299

[45] Date of Patent: Aug. 2, 1988

[54] METHOD AND APPARATUS FOR ELECTROSTATIC SPRAY COATING

[75] Inventors: Patrick A. Hufstetler, Mt. Clemens, Mich.; James E. Hynds, 7147 Creeks Crossing, W. Bloomfield, Mich. 48033

[73] Assignee: James E. Hynds, West Bloomfield, Mich.

[21] Appl. No.: 33,028

[22] Filed: Mar. 31, 1987

[51] Int. Cl.[4] ..... B05D 1/04

[52] U.S. Cl. ..... 427/27; 118/629; 118/630; 118/631

[58] Field of Search ..... 427/27; 118/629, 630, 118/631

[56] References Cited

U.S. PATENT DOCUMENTS

| | | | |
|---|---|---|---|
| 2,302,185 | 11/1942 | Campbell | 118/629 X |
| 2,766,064 | 10/1956 | Schweitzer | 118/629 X |
| 3,382,091 | 5/1968 | Drum | 118/629 X |
| 3,463,121 | 8/1969 | Walberg | 118/631 |
| 4,077,354 | 3/1978 | Walberg | 118/629 |
| 4,313,968 | 2/1982 | Sickles et al. | 427/27 |

FOREIGN PATENT DOCUMENTS

| | | | |
|---|---|---|---|
| 591980 | 2/1960 | Canada | 118/629 |

*Primary Examiner*—Shrive P. Beck
*Attorney, Agent, or Firm*—Brooks & Kushman

[57] ABSTRACT

Method and apparatus are provided for electrostatically spray coating an article in a coating zone with a liquid coating material, such as paint, wherein air is supplied to the spray head of an air spray gun at an atomizing air flow rate in excess of 5 CFM and at a delivery pressure of less than 15 psi to atomize the liquid coating material. At this combination of relatively low pressure and relatively high volume of air the transfer efficiency is substantially higher than for conventional air spray guns. A turbine unit filters and heats the air so that the air has a temperature in excess of 70° F. at the spray head. An elongated conductive rod is reciprocably supported within a nozzle of the spray head to create an electrical charge differential between the atomized liquid coating material and the article in the coating zone when charged by a high voltage source. Preferably, the rod is positioned within a liquid discharge orifice of the nozzle to alternatively open and close the nozzle. Also, preferably, the air flow rate at the spray head is in the range of 5–35 CFM, and the air delivery pressure at the spray head is in the range of three to nine psi over atmospheric pressure.

21 Claims, 5 Drawing Sheets

METHOD AND APPARATUS FOR ELECTROSTATIC SPRAY COATING

TECHNICAL FIELD

This invention relates to method and apparatus for electrostatically spray coating an article in a coating zone with a liquid coating material and, in particular, to method and apparatus for electrostatically spray coating an article in a coating zone wherein air having a relatively high flow rate and a relatively low delivery pressure is utilized to atomize the liquid coating material.

BACKGROUND ART

Electrostatic spray finishing is a painting process that uses the particle-attracting properties of electrostatic charges to gain peak efficiency in spray operations. Electrical charges are generally applied to the paint particles in one of two ways: by induction charging or by ion bombardment.

Both types of electrical charging take place during the process of atomization. Induction charging occurs when the paint is still in contact with the high-voltage electrode or metal injector in the tip of the nozzle of the spray gun. Ion bombardment, on the other hand, alters the paint droplets as they are forced out through the gun's nozzle because of the ionization of air around the electrode of the metal injector tip.

Generally, in electrostatic spray operations, a negative charge is applied to the coating, while the target product is grounded. When the electrostatically charged paint droplets are introduced into an electric field of the grounded target, they behave like tiny magnets, and the lines of force in the field (i.e. the corona) become the lines along which the paint particles are carried to the target. As the level of d-c voltage increases, so does the density of the lines of force. Consequently, the higher the voltage, the greater the number of lines of paint that will wrap around the edges of the target, thus enhancing the coating application at the edges.

The coating-to-product transfer efficiency of electrostatic spray finishing operations is high because as the paint particles are attracted to the target they literally wrap around it. This principle, commonly referred to as wrap-around, is one of the primary reasons this finishing technique can result in 60–90% transfer efficiency in coating material usage when compared to other finishing operations in which a great deal of paint is lost to overspray or blow-by. This marked savings in material is a prime motivating factor in the movement toward electrostatic finishing techniques.

The use of electrostatics, like any other technology, has its limitations. The electrostatic attraction of any coating material is greater on outer edges and hole edges, thus causing a heavier buildup in these areas. This edge phenomenon is caused by magnetic forces that are concentrated on an object's outer surfaces, and any sharp edge becomes a collection point. However, this excess buildup can be controlled by the application method and the applied charge.

Another problem associated with electrostatic spray finishing is what is known as the Faraday cage effect, caused by the focused concentration of the applied charge. As a result, only minimal amounts of coating reach recessed areas of the target, especially on parts with complicated configurations. If both the target and paint are charged with opposite polarity, however, the Faraday cage effect is dramatically reduced, virtually eliminating the need for additional touch-ups. Still, in some cases, a separate conventional air spray application is advised to ensure complete coverage.

There are two basic types of electrostatic spraying systems currently in use. The first is known as an uninhibited or nonresistive system. Uninhibited systems are characterized by the application of voltage or electron flow directly to the atomization device. The coating material is fed through the atomizer where it picks up a high-voltage charge. There is very little resistance, if any, placed in the atomizer cable, the power supply or the atomizer. An uninhibited system requires stringent control measures because the entire atomizer is charged. For this reason, uninhibited systems are usually incorporated only into automatic finishing operations in which it is possible to isolate the spray area.

Inhibited or resistive systems, on the other hand, involve the closely controlled channeling of high voltage through the spraying device by limiting the amount of current at the device. The power supply, in effect, pumps the electrons through a series of current-limiting resistors to the electrode. The wire is covered with insulating material which, in turn, is covered by a ground-shield. This precaution prevents the escape of voltage or current. The spray gun itself is made of an insulative material, and resistors within it control the flow of electrons as they make their way to the tip of the electrode and into the atmosphere, charging the paint particles.

In general, the inhibited system consists of features that allow the operator to handle the atomizing equipment as though it were any other electrical appliance. Handheld electrostatic guns are referred to as inhibited when the applied voltage ranges up to 90,000 V. Inhibited automatic electrostatic systems have voltage ranges up to 135,000 V.

In any system, whether uninhibited or inhibited, the atomization of the coating material and the velocity of the atomized particles are the major parameters for judging the efficiency of a system. Smaller particles are lighter and thus are more easily drawn to the grounded target object. The velocity of the coating particles should be fairly slow in order to avoid blow-by which occurs when the material moves past the target too fast to adhere properly. The greatest efficiency is usually achieved in systems offering optimum atomization coupled with the lowest possible velocity of particles.

In one system the force of air is utilized to atomize the coating particles. A high-voltage charge is induced into the spray pattern and electrostatically charges the atomized coating particles. The attraction between these charged particles and the object to be coated is powerful enough to cause the overspray to bend or wrap around the back side of the object. Electrostatic air spray systems normally offer good wrap-around performance, highly uniform film build and smooth finish, material savings, and reduced emissions. Most air spray equipment is adjustable, and liquid flow rates can be set up to 50 oz. per minute.

For example, the U.S. Patent to Watanabe et al U.S. Pat. No. 3,093,309 discloses electrostatic coating apparatus of the spray gun type which utilizes compressed air and a plurality of nozzles mounted on a single air spray gun to lower spray velocity. The lower air stream velocity increases the effect of the adsorbent force of the electric field applied to the atomized coating material. In this way, the volume of coating material flying out of the electric field is decreased. However, the plurality of nozzles mounted on a single air spray gun is awkward to move and control in order to uniformly coat a work surface. Each nozzle delivers a relatively small amount of atomized spray since the fluid flows under a relatively low fluid pressure.

Atomization can be accomplished through a number of other methods, including the use of rotary atomizers such as stationary and hand-operated bells. In a bell or disk system, centrifugal forces atomize the paint, and the high-voltage differential between the paint dispenser and the grounded target attracts the paint to the part.

Airless electrostatic spray systems use hydraulic pressure to atomize the fluid by discharging it through a small opening at pressures of 500–4500 psi. As the fluid is released, it is atomized into fine particles at a velocity sufficient to carry the atomized coating to the target. Airless electrostatic equipment is often used when overspray must be kept to a minimum and film buildup of three of four mils is required. Such systems are also used where fine finishes are not required.

A relatively new method used for electrostatic spray finishing is the air-assisted airless system. It also offers the wrap-around performance of other electrostatic equipment. In this system, medium fluid pressure—300–1000 psi—is used to atomize the coating material and shape it into the desired fan pattern. An air-assist is applied to the spray pattern, enhancing the atomization process and doing away with tails that would mar the finish.

The various spray devices may be fitted to handheld, automatic, or robot spray equipment. Handheld electrostatic spray gun systems usually consist of a handgun, fluid and air hoses, high-voltage cables, and a high-voltage power pack that converts a-c line voltage to d-c voltage. The power pack also contains air and electrically operated switches necessary to control air flow and electric voltage and current to the spray gun.

In manual spraying, all variables of the system, such as fluid flow rate, atomizing pressure, fan shape, and the sweep pattern of the gun, are selected by the operator. The operator must be skilled enough to detect when the film buildup is too heavy or not heavy enough. Manual spray finishing is most often used when a wide variety of parts must be painted.

Automatic systems incorporate some of the same components as those of manual systems: a power pack, high-voltage cables, and electrostatic spray guns. The high-voltage power pack, though, is usually wall-mounted and remote-controlled. The power pack used in automatic spray operations may often generate twice the electrostatic charge of handheld equipment, and this charge can be adjusted in relation to the type of coating material used. The high voltage cables must be insulated and capable of withstanding the powerful charge. The spray guns themselves may be fixed to the floor, on reciprocating arms, or in an overhead configuration. System variables are preset for the production run, and an operator monitors the system to ensure that these parameters remain within the specified tolerances. Although, in theory, it is possible to program the equipment so that all parts moving through the system receive an acceptable coating, some areas tend to receive a too-thick or too-thin application. Therefore, some degree of secondary touch-up is often warranted. Automatic systems are used when a limited number of different systems are used when a limited number of different parts are to be painted. High-production finishing of similar parts is almost aways carried out in an automatic system. An early example of such an automatic system is disclosed in the U.S. Patent to Tilney et al U.S. Pat. No. 3,279,421.

Robotic spray finishing systems are like standard automatic systems except that the spraying is performed by robots capable of mimicking the movements of a human painter. The robot is programmed to carry out the required tasks, and the program's speed is adjusted in relation to the speed of a conveyor as it moves the target parts through the spray area. Robots are currently being used in spray operations that are monotonous and repetitive, those that require complete and uniform application of the coating material, and those that pose serious health hazards to human operators.

Finishing robots have found a secure niche in the automotive industry. Automobile body contours are well-suited to electrostatic finishing, and the high production runs justify the cost of robotic systems. Examples of such robotic spray finishing systems which utilize rotary atomizers are disclosed in U.S. Patents to Vecellio U.S. Pat. Nos. 4,532,148 and 4,539,932 and the U.S. Pat. No. 4,601,921 to Lee Each of the Vecellio patents discusses the relatively low transfer efficiency of robotized air-spray gun systems which is attributed in large part to the use of high pressure air for atomizing the liquid coating material.

DISCLOSURE OF THE INVENTION

An object of the present invention is to provide an improved method and apparatus for electrostatically spray-coating which utilizes air having a relatively low pressure and a relatively high flow rate to provide proper liquid atomization yet relatively low particle velocity.

Another object of the present invention is to provide an improved method and apparatus for electrostatically spray-coating wherein air is delivered to an atomizing device having a spray head, which air has a flow rate in excess of 5 CFM at the spray head and a delivery pressure of less than 15 psi at the spray head.

Yet still another object of the present invention is to provide an improved method and apparatus for electrostatically spray-coating wherein a turbine unit is provided for supplying high volume, low pressure heated air to an atomizing device, such as an air spray gun having a spray head, and wherein the air has a flow rate in excess of 5 CFM at the spray head and a delivery pressure in the range of one to nine psi at the spray head. The method and apparatus takes advantage of the high volume of air supplied to the spray head which has an air cap with considerably larger air orifices than conventional air caps.

In carrying out the above objects and other objects of the present invention, a method for electrostatically spray-coating an article in a coating zone with a liquid coating material includes the steps of supplying air to an air atomizing device having a spray head and supplying the liquid coating material to the atomizing device. The method further includes the step of utilizing the atomizing device to atomize the liquid coating material with the air, the air having a flow rate in excess of 5 CFM at the spray head and a delivery pressure of less than 15 psi at the spray head. Finally, the method further includes the step of creating an electrical charge differential between the atomized liquid coating material and the article in the coating zone for causing the atomized liquid coating material to be directed to the article.

Further in carrying out the above objects and other objects of the present invention, an apparatus for electrostatically spray-coating an article in a coating zone includes an atomizing device having an input liquid coating passage, a separate input air passage and a spray head. The coating passage provides a connection to a source of liquid coating material. The apparatus further includes a source of air for connection to the air passage. The air has a flow rate in excess of 5 CFM at the spray head and a delivery pressure of less than 15 psi at the spray head. The atomizing device utilizes the air to atomize the liquid coating material at the spray head. Finally, the apparatus further includes means, including a high-voltage source, for creating an electrical charge differential between the atomized liquid coating material and the article in the coating zone.

Preferably, the delivery pressure is in the range of one to nine psi and the flow rate is in excess of 10 CFM.

Also, preferably, a turbine unit supplies the air to the atomizing device so that the temperature of the air at the spray head is in excess of 70° F.

The advantage accruing to the use of the method and apparatus of the present invention are numerous. For example, the transfer efficiency of the method and apparatus is greatly improved over prior art methods and apparatus through the use of the relatively low pressure and relatively high volume of air to atomize the liquid coating material at the spray head. Consequently, the transfer efficiency approaches that of a bell or disk atomizer while providing the directional control of an air spray gun. Also, the warm atomizing air allows for quicker drying of the liquid coating material. In addition, the method and apparatus of the present invention are readily adapted for use with other hand-held, automatic and robotic spray equipment.

The advantages of the present invention will be readily appreciated as the same become better understood by reference to the following detailed description when taken in connection with the accompanying drawings.

BEST MODE FOR CARRYING OUT THE INVENTION

Figure 1:
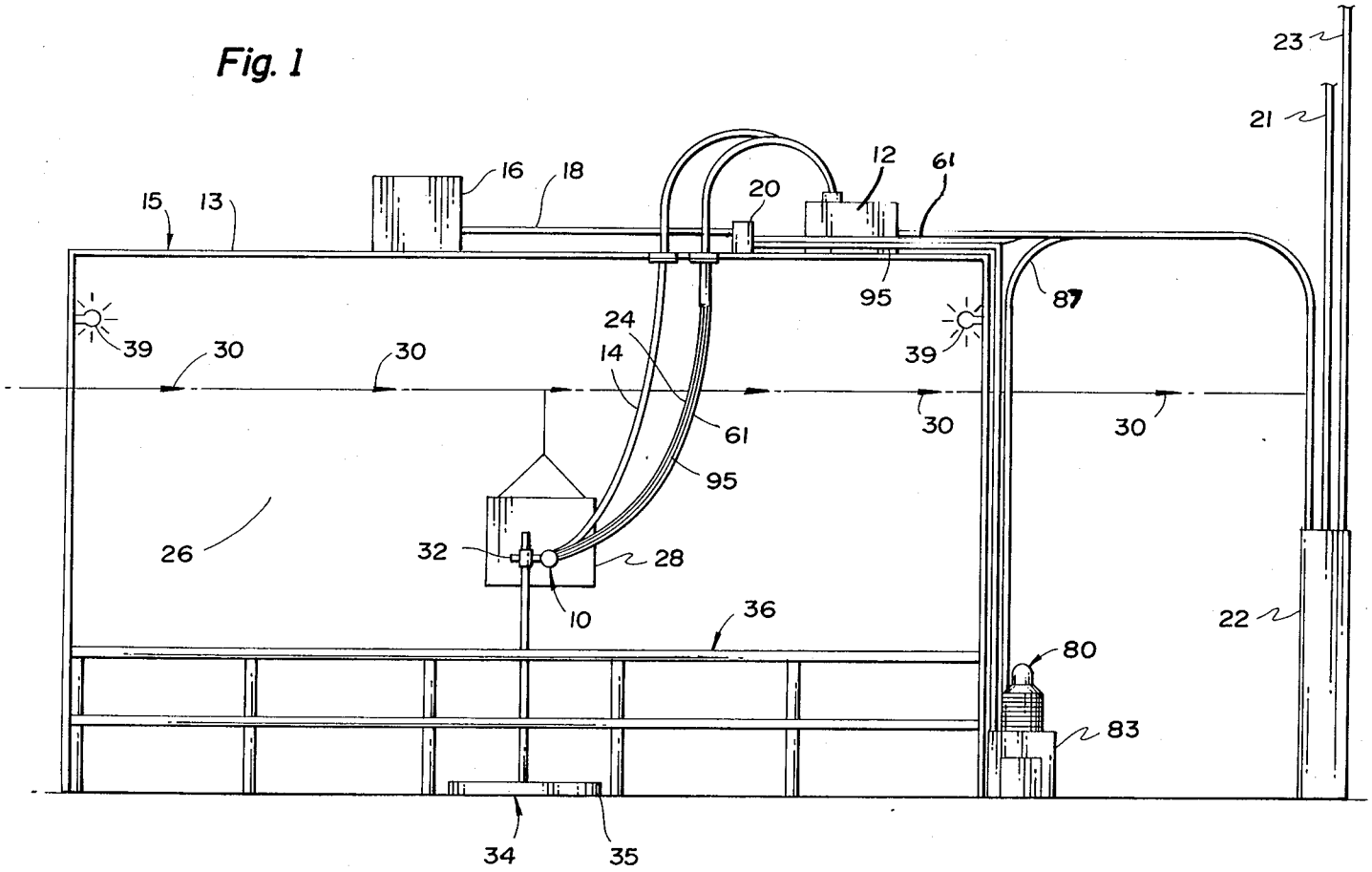
FIG. 1 is a side elevational schematic view illustrating a system incorporating the method and apparatus of the present invention.
Figure 2:
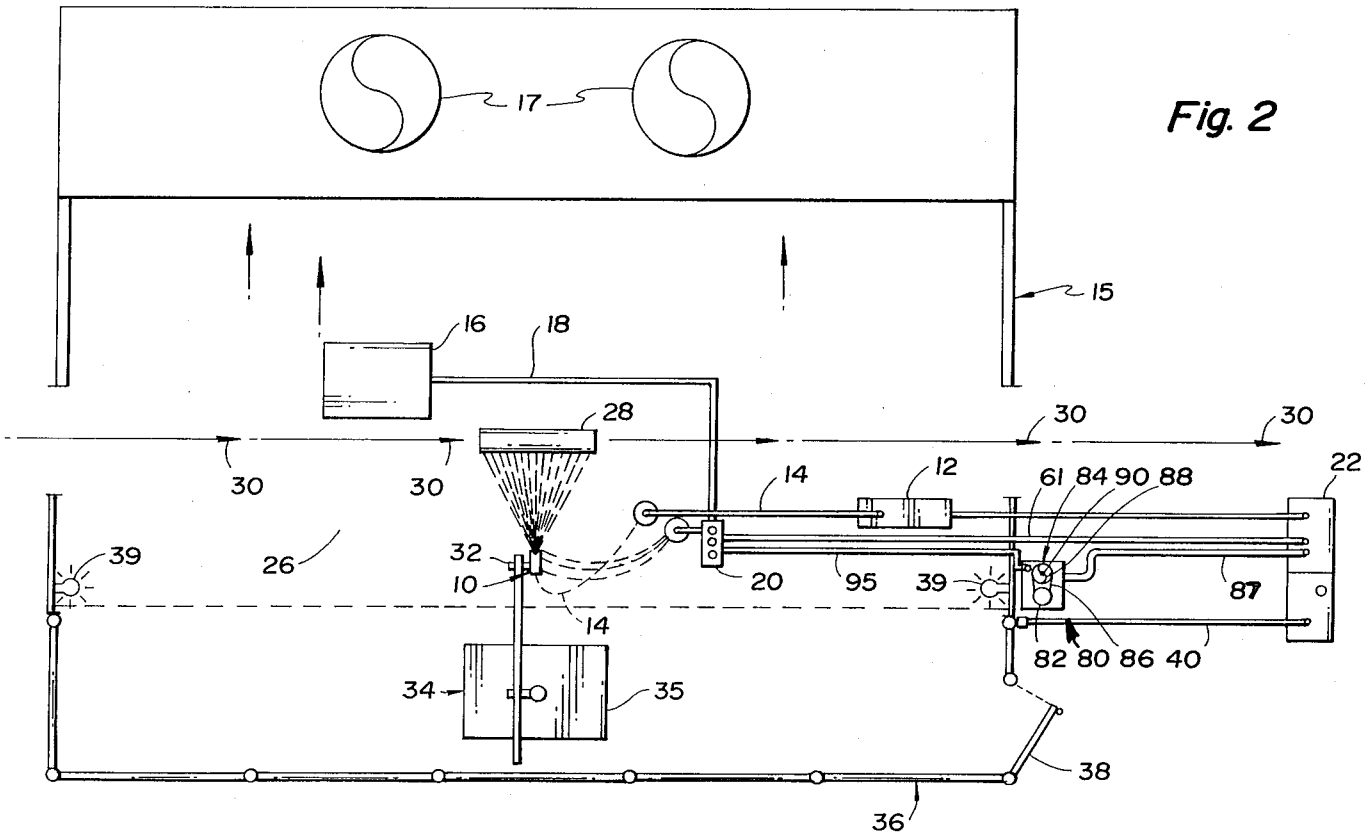
FIG. 2 is top plan view of the system of FIG. 1.

Referring now to FIGS. 1 and 2 there is illustrated an uninhibited electrostatic air spray system utilizing the method and apparatus of the present invention for coating parts. However, it is to be understood that the method and apparatus could also be readily incorporated into an inhibited air spray system.

For example, in an inhibited or resistive system, a spray gun such as a spray gun, generally indicated at 10, could be made of an insulator material and could include an air-driven alternator or generator built into the gun 10 itself to rectify and multiply the voltage to current limiting resistors therein. Alternatively, a step-up transformer or multiplier could be built into the gun 10 itself.

The apparatus includes an atomizing device, such as the electrostatic air spray gun 10. The gun 10 is supplied with relatively high D.C. voltage, on the order of 100 kv, from a high voltage transformer 12 by a cable 14. The transformer 12 is preferably mounted on an insulated bulkhead 13 of a spray booth 15 of the system. Blowers 17 are mounted in the ceiling of the spray booth 15 to exhaust the spray booth 15 in a conventional fashion.

A liquid coating material, such as paint, is stored in a container 16 also shown mounted on the bulkhead 13. However, it is to be understood that the container 16 preferably comprises a pressure pot, a circulating system or other conventional system. The liquid coating material flows through a line 18 to a pilot-operated regulator 20 which contains air-controlled switches to control the flow of air and paint to the spray gun 10. In turn, the regulator 20 is controlled from a control unit 22 which provides air control signals to the regulator 20. The control unit 22 is connected to an outside source of air through a conduit 21 and to a source of A.C. electrical power via a cable 23.

The paint flows from the regulator 20 through a paint line 24 which is fluidly connected to the air spray gun 10.

Because there is very little electrical resistance in the cable 14 or in the gun 10, a coating area or zone 26 in which parts 28 are coated is isolated from its surroundings as illustrated in FIGS. 1 and 2. The part 28 is conveyed through the coating zone 26 by a conveyor (not shown) in the direction of arrows 30. A high electrical charge differential or potential gradient is provided between the air spray gun 10 and the part 28 in the coating zone 26 to cause the atomized paint to be directed to the part 28. The conveyor electrically grounds the part 28 in a conventional fashion.

The air spray gun 10 includes a cylindrical support member 32 by which the air spray gun 10 is supported on an isolation stand, generally indicated at 34. The stand 34 is insulated from the gun 10 by a base 35 of phenolic or high density nylon material.

The system includes a safety fence, generally indicated at 36, having an interlock gate 38 to isolate the coating zone 26 within the spray booth 15. The control unit 22 is coupled to the safety fence 36 along line 40 so that when the gate 38 is open, the control unit 22 will not only interrupt the electrical power to the spray gun 10, but will also signal the regulator 20 to interrupt the flow of paint and turn on warning lamps 39 within the coating area 26.

Figure 5:
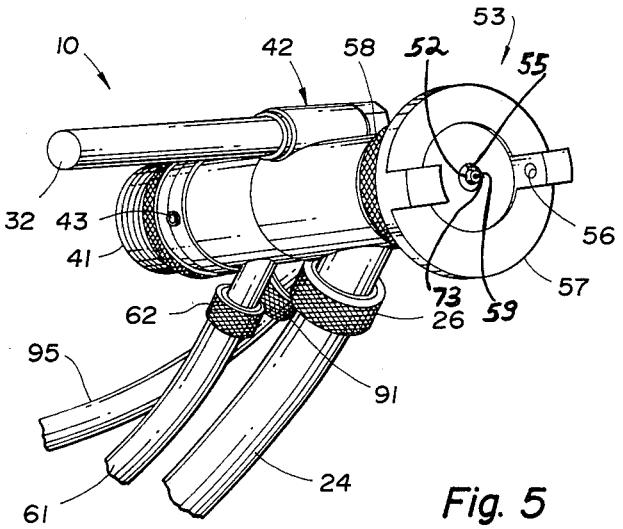
FIG. 5 is a perspective view of a portion of an electrostatic air spray gun of the present invention.
Figure 6:
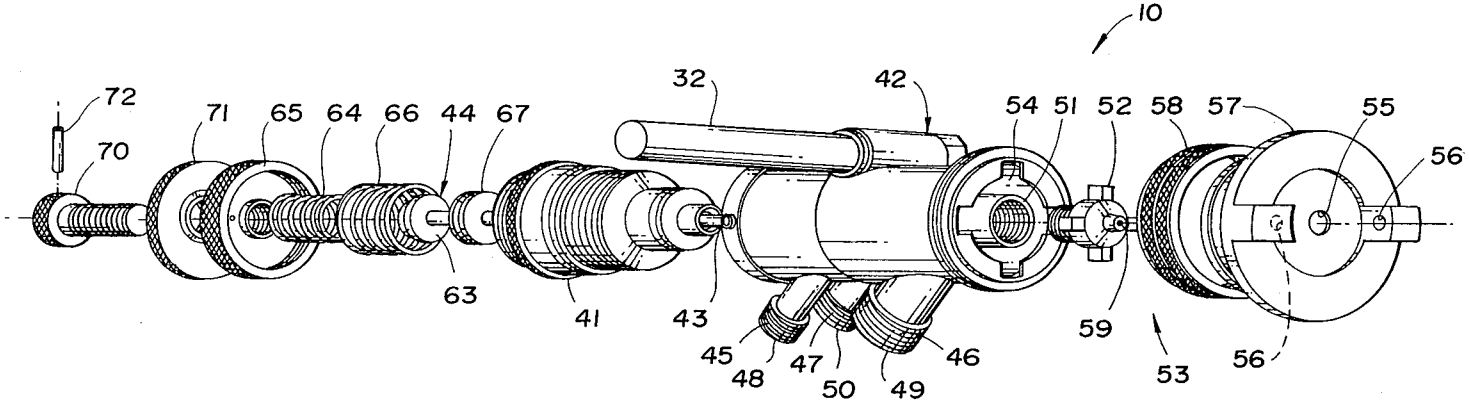
FIG. 6 is an exploded perspective view of the gun of FIG. 5.
Figure 7:
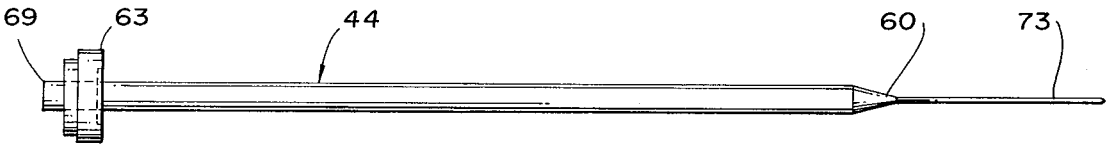
FIG. 7 is a slightly enlarged side elevational view of a conductive fluid needle of the gun.

Referring to FIGS. 5, 6 and 7, the voltage transformer 12 supplies a high-voltage current via cable 14 to an elongated electrode, generally indicated at 44, slidably supported within a threaded control body portion 41 of the gun 10. The body portion 41 is threadedly connected to an outer housing, generally indicated at 42, of the gun 10 and is secured thereto by screws 43 (only one of which is shown). The body portion 42 includes integrally formed, externally threaded, nipples 45, 46 and 47 which define control air, input air and input liquid coating passages 48, 48 and 50, respectively. The liquid coating passage 50 is fluidly connected to an internally threaded barrel 51. A nozzle 52 of a spray head, generally indicated at 53, is threadedly secured within the barrel 51.

The input air passage 49 is in fluid communication with an annular passage 54 located about the barrel 51 within the outer housing 42. In turn, the passage 54 is in fluid communication with a circular air discharge orifice 55 and a pair of shaping air orifices 56 formed in a plastic air cap 57 of the spray head 53. The plastic air cap 57 is threadedly connected to the outer housing 42 by a threaded fitting 58 so that a liquid discharge orifice 59 formed through the nozzle 52 as well as the nozzle 52 are centrally disposed within the air discharge orifice 55 as shown in FIG. 5.

The pair of opposed shaping air orifices 56 and the air discharge orifice 55 all direct air toward the coating material sprayed from the nozzle 52 to atomize the liquid coating material. The air from the orifices 56 also shape the resulting pattern of atomized liquid coating material.

The electrode 44 is also supported for movement within the nozzle 52 so that a shoulder portion 60 of the electrode 44 alternately opens and closes the liquid discharge orifice 59 in response to pneumatic control signals. The control unit 22 supplies the pneumatic control signals to the nipple 45 through a line 61 which leads to and away from the regulator 20. A fitting 62 secures the connection of the line 61 to the nipple 45.

The electrode 44 has a shoulder portion 63 which is biased toward the spray head 53 by a first spring 64 which extends between the shoulder portion 63 and a first annular end member 65. The end member 65 is threadedly connected to one end of the body portion 41.

A second spring 66 disposed about the shoulder portion 63 biases a piston member 67 within the body portion 41 towards the spray head 53. The electrode 44 extends through and is fluidly sealed within the piston member 67.

A first air control signal along line 61 appears on one side of the shoulder portion 63 of the electrode 44 to move the electrode 44 in a first direction along its longitudinal axis against the biasing action of the first spring 64 to thereby expose or open the liquid discharge orifice 59. This movement also electrically couples a first end portion 69 of the electrode 44 to an electrically conductive screw 70 which extends through the first annular end member 68 and a second annular end member 71 and is threadedly connected thereto. In turn, the screw 70 is electrically connected to the cable 14 by a conductor 72 for providing an electrical charge at the tip 73 of the electrode 44. The tip 73 extends through the orifice 59 to charge the paint sprayed therethrough.

A second control signal (i.e. atmospheric pressure) causes the electrode 44 to move in the opposite direction under the biasing action of the first spring 64 to thereby close the liquid discharge orifice 59 and break the electrical connection to the screw 70.

Preferably, the orifice 59 has a diameter in the range of 1 to 2 mm, the orifice 55 has a diameter in the range of 5 to 9 mm and each of the orifices 56 has a diameter in the range of 2 to 5 mm. Obviously, the larger the air orifices 55 and 56 the higher the CMF for utilization with high liquid coating material flow rates and/or material with higher viscosity.

The method and apparatus of the present invention also preferably includes an air turbine unit, generally indicated at 80, which is generally commercially available for non-electrostatic air spray painting operations. The turbine unit 80 is preferably capable of supplying air at an outlet 81 having a flow rate from 20 to 85 CFM and a pressure from 3 to 15 psi over atmospheric pressure. The air flow rate and delivery pressure at the sprayhead 53 prior to directing the air to the air orifices 55 and 56 can be made to vary depending on the velocity and type of liquid coating material used (i.e. its viscosity) and the number of spray guns used.

Figure 4:
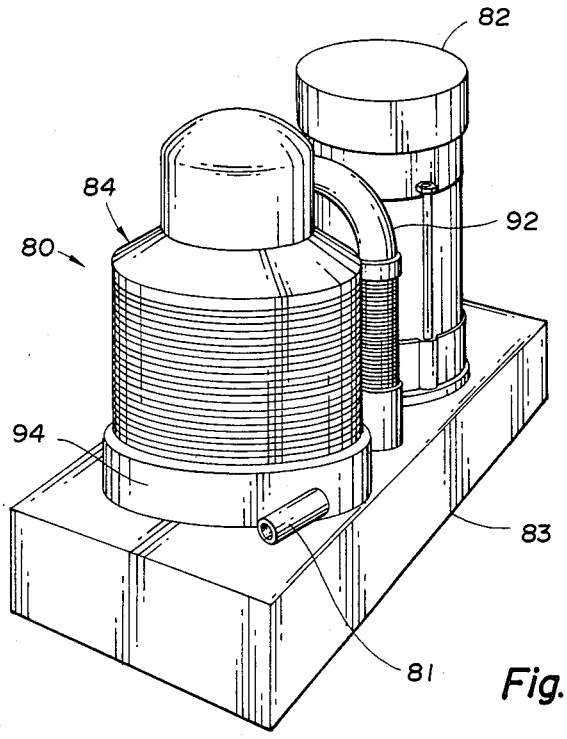
FIG. 4 is a perspective view of a turbine unit of the present invention.

As best shown in FIGS. 2 and 4, the turbine unit 80 includes a variable speed electric motor assembly 82 mounted on a hollow base 82 of the unit 80. A conduit 87 provides electrical power to the motor assembly 82 from the control unit 22. An output drive shaft of the motor assembly 82 is coupled to a central spindle 90 of a turbine or turbine assembly 84 by a drive belt 86. The drive belt 86 turns the central spindle 90 on which a stack of spaced vanes 88 are supported to rotate therewith at a variable controlled speed to, in turn, vary the pressure and volume of air at the outlet 81. The preferred angular velocity of the control spindle 90 is approximately 12,000 rpm.

Outside air enters the turbine assembly 84 through an air inlet 92. Within the turbine assembly 84 the air is pressurized and heated by the rotating vanes 88. The resulting high-volume, pressurized heated air is then filtered by an air filter located in a base 94 of the turbine assembly 84. The air outlet 81 extends from the base 94 of the turbine 54 to supply the pressurized, heated and filtered air to a line 95 which leads to and from the regulator 20 and which is connected to the input air passage 50 of the gun 10 by a threaded fitting 91. At the turbine unit 80 the air is heated to approximately 250° F. so that the air is approximately in the range of 70°-160° F. at the spray head 53 of the gun 10.

Figure 3:
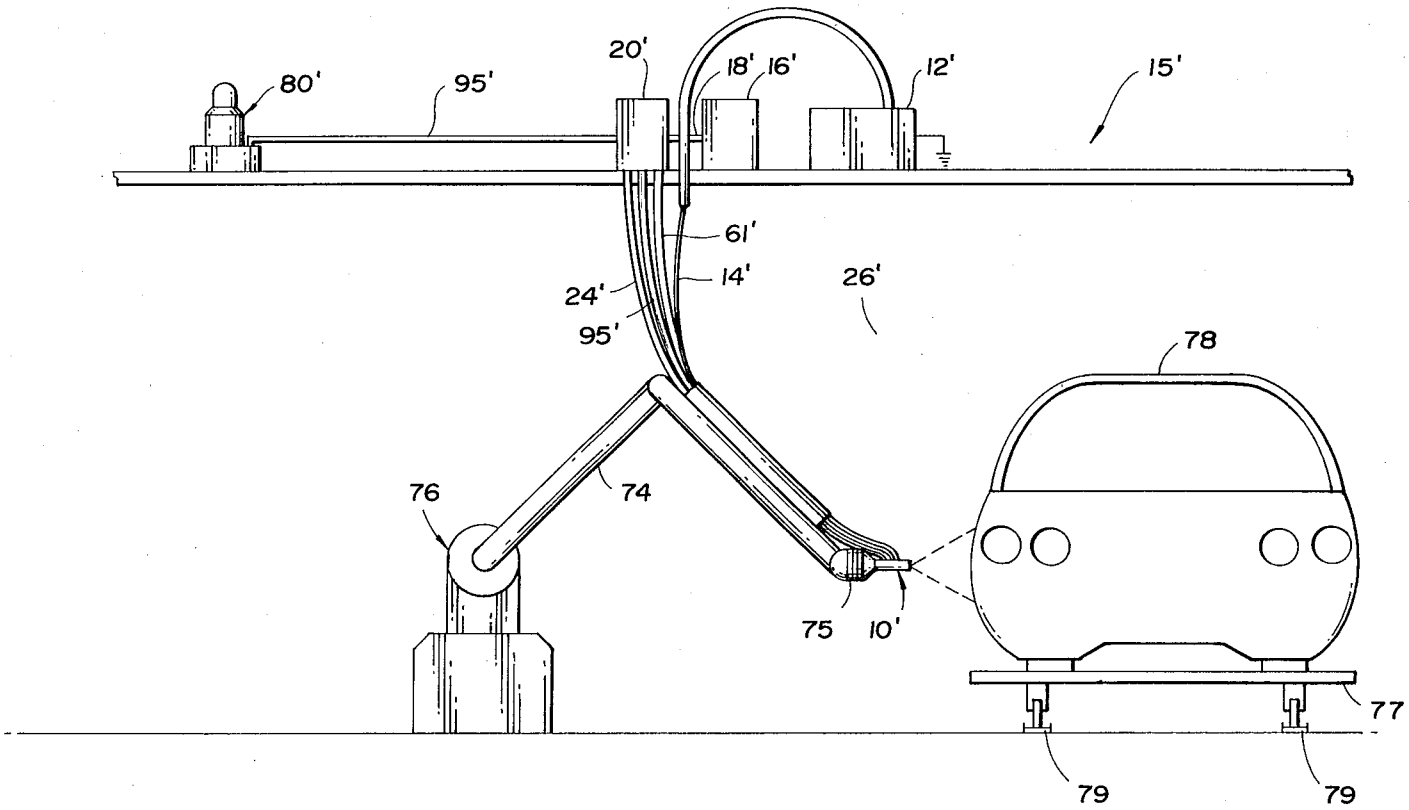
FIG. 3 is an end view illustrating a second system incorporating the method and apparatus of the present invention.

Referring now to FIG. 3, there is illustrated a second embodiment of the method and apparatus of the present invention wherein structure which is substantially the same in function as structure of the first embodiment has the same numeral but is primed.

Instead of the isolation stand 34, a modified spray gun, generally indicated at 10', is supported on a wrist mechanism 75 of an arm 74 of a robot, generally indicated at 76. So mounted, the apparatus of the present invention is capable of spraying an automobile body 78 mounted on a wheeled carrier 77 which, in turn, moves along a track 70 through a coating area 26'. While not shown, the carrier 77 may be connected to a power-driven conveyor chain to move the loaded carrier 77 through the coating area 26'.

A robot, such as the robot 76, provides programmed, multi-axes, spray gun movement and is generally commercially available, as illustrated in both of the above-noted U.S. Patents to Vecellio.

The method and apparatus of the present invention provide numerous advantages. For example, better transfer efficiencies are obtained with such electrostatic air spray apparatus. Furthermore, the relatively warm, dry air from the turbine unit 80 allows for quicker drying of the atomized liquid coating material. Finally, the method and apparatus are equally applicable for use in handheld, automatic or robotic systems.

The invention has been described in an illustrative manner, and, it is to be understood that, the terminology which has been used is intended to be in the nature of words of description, rather than of limitation.

Obviously, many modifications and variations of the present invention are possible in light of the above teachings. It is, therefore, to be understood that, within the scope of the appended claims, the invention may be practiced otherwise than as specifically described.

What is claimed is:

1. A method for electrostatically spray-coating an article in a coating zone with a liquid coating material, the method comprising the steps of:

supplying air to an atomizing device having a spray head;

supplying the liquid coating material to the atomizing device;

utilizing the air entering the atomizing device to atomize the liquid coating material with the air at the spray head, the air having a flow rate in excess of 5 CFM at the spray head and a delivery pressure of less than 15 psi over atmospheric pressure at the spray head; and creating an electrical charge differential between the atomized liquid coating material and the article in the coating zone for causing the atomized liquid coating material to be directed to the article.

2. The method as claimed in claim 1 wherein the delivery pressure at the spray head is in the range of one to nine psi over atmospheric pressure.

3. The method as claimed in claim 2 wherein the flow rate at the spray head is in excess of 10 CFM.

4. The method as claimed in claim 3 wherein said method further comprises the step of filtering the air before the step of utilizing.

5. The method as claimed in claim 1 or claim 2 or claim 3 or claim 4 wherein said method further comprises the step of increasing the temperature of the air at the spray head to a temperature in excess of 70° F.

6. A method for electrostatically spray-coating an article in a coating zone with a liquid coating material, the method utilizing a turbine which includes a series of vanes supported on a central spindle, the method comprising the steps of:

rotating the central spindle of the turbine to cause air supplied to the interior of the turbine to flow from an air outlet of the turbine;

supplying air from the air outlet to an atomizing device having a spray head;

supplying the liquid coating material to the atomizing device;

utilizing the air entering the atomizing device to atomize the liquid coating material with the air at the spray head, the air having a flow rate in excess of 5 CFM at the spray head and a delivery pressure of less than 15 psi over atmospheric pressure at the spray head; and creating an electrical charge differential between the atomized liquid coating material and the article in the coating zone for causing the atomized liquid coating material to be directed to the article.

7. Apparatus for electrostatically spray-coating an article in a coating zone, the apparatus comprising:

an atomizing device having an input liquid coating passage, a separate input air passage and a spray head, said coating passage providing a connection to a source of liquid coating material;

a source of air for connection to the air passage, the air having a flow rate in excess of 5 CFM at the spray head and a delivery pressure of less than 15 psi over atmospheric pressure at the spray head, the atomizing device utilizing the air entering the atomizing device to atomize the liquid coating material at the spray head; and means, including a high voltage source, for creating an electrical charge differential between the atomized liquid coating material and the article in the coating zone.

8. The apparatus as claimed in claim 7 wherein said spray head includes a nozzle for spraying liquid coating material and wherein said means for creating includes an elongated electrically conductive member disposed adjacent the nozzle and adapted to be coupled to the voltage source.

9. The apparatus as claimed in claim 8 wherein said conductive member is movably supported within a liquid discharge orifice of the nozzle, said conductive member opening said discharge orifice to, in turn, fluidly connect the discharge orifice and the coating passage.

10. The apparatus as claimed in claim 9 wherein said device includes an input control passage providing a connection to a source of fluid control signals to control movement of the conductive member.

11. The apparatus as claimed in claim 7 wherein the delivery pressure at the spray head is in the range of one to nine psi over atmospheric pressure.

12. The apparatus as claimed in claim 11 wherein the flow rate at the spray head is in excess of 10 CFM.

13. The apparatus as claimed in claim 12 wherein said source of air includes a turbine unit, the turbine unit increasing the temperature of the air at the spray head to a temperature in excess of 70° F.

14. The apparatus as claimed in claim 13 further comprising filter means associated with the turbine unit for filtering the air.

15. The apparatus as claimed in claim 13 or claim 14 wherein said turbine unit includes a turbine having an air inlet and an air outlet and a motor in driving engagement with the turbine to actuate the turbine, the actuated turbine drawing air into its air inlet and providing the air at the air outlet.

16. Apparatus for electrostatically spray-coating an article in a coating zone, the apparatus comprising:

an atomizing device having an input coating passage, a separate input air passage and a spray head, said coating passage providing a connection to a source of liquid coating material;

a source of air for connection to the air passage, the source of air including a turbine having a series of vanes supported on a central spindle for causing air supplied to the interior of the turbine to have a flow rate in excess of 5 CFM at the spray head and a delivery pressure of less than 15 psi over atmospheric pressure at the spray head, the atomizing device utilizing the air entering the atomizing device to atomize the coating material at the spray head; and means, including a high voltage source, for creating an electrical charge differential between the atomized liquid coating material and the article in the coating zone.

17. The invention as claimed in claim 1 or claim 6 or claim 7 or claim 16 wherein the spray head includes a single nozzle having a liquid discharge orifice for spraying the liquid coating material.

18. The invention as claimed in claim 17 wherein the spray head includes an air cap having an air discharge orifice, said air discharge orifice directing air toward the liquid coating material discharged from the liquid discharge orifice to atomize the liquid coating material.

19. The invention as claimed in claim 18 wherein said air discharge orifice is radially disposed about said liquid discharge orifice.

20. The invention as claimed in claim 19 wherein the air cap has a pair of shaping air orifices disposed on opposite sides of the liquid discharge orifice, said shaping air orifices directing air toward the discharged liquid coating material to further atomize the liquid coating material and to shape the resulting pattern of atomized liquid coating material.

21. The invention as claimed in claim 20 wherein each of the shaping air orifices has a diameter in the range of 2 to 5 mm, the liquid discharge orifice has a diameter in the range of 1 to 2 mm and the atomizing air discharge orifice has a diameter in the range of 5 to 9 mm.

* * * * *

US004761299B1

REEXAMINATION CERTIFICATE (3164th)

United States Patent [19] [11] B1 4,761,299

Hufstetler et al. [45] Certificate Issued Apr. 1, 1997

[54] METHOD AND APPARATUS FOR ELECTROSTATIC SPRAY COATING

[75] Inventors: Patrick A. Hufstetler, Mt. Clemens; James E. Hynds, W. Bloomfield, both of Mich.

[73] Assignee: Ransburg Corporation, Indianapolis, Ind.

Reexamination Request:
No. 90/002,914, Dec. 31, 1992

Reexamination Certificate for:

| | |
|---|---|
| Patent No.: | **4,761,299** |
| Issued: | **Aug. 2, 1988** |
| Appl. No.: | **33,028** |
| Filed: | **Mar. 31, 1987** |

[51] Int. Cl.[6] ..... B05D 1/04

[52] U.S. Cl. ..... 427/483; 118/629; 118/630; 118/631

[58] Field of Search ..... 427/475, 483; 118/629, 630, 631; 239/3, 704, 705, 706, 708

[56] References Cited

U.S. PATENT DOCUMENTS

| | | | |
|---|---|---|---|
| 3,093,309 | 6/1963 | Watanabe | 239/696 |
| 3,169,882 | 2/1965 | Juvinall et al. . | |
| 3,296,015 | 1/1967 | Juvinall et al. | 427/483 |
| 3,635,400 | 1/1972 | Nord et al. | 239/422 |
| 4,002,777 | 1/1977 | Juvinall et al. | 427/483 |
| 4,232,824 | 11/1980 | Binoche | 239/8 |
| 4,273,293 | 6/1981 | Hastings | 239/705 |
| 4,341,347 | 7/1982 | Devittorio | 239/3 |
| 4,601,921 | 7/1986 | Lee | 427/483 |
| 4,765,539 | 8/1988 | Noakes et al. | 239/3 |

*Primary Examiner*—Shrive P. Beck

[57] ABSTRACT

Method and apparatus are provided for electrostatically spray coating an article in a coating zone with a liquid coating material, such as paint, wherein air is supplied to the spray head of an air spray gun at an atomizing air flow rate in excess of 5 CFM and at a delivery pressure of less than 15 psi to atomize the liquid coating material. At this combination of relatively low pressure and relatively high volume of air the transfer efficiency is substantially higher than for conventional air spray guns. A turbine unit filters and heats the air so that the air has a temperature in excess of 70° F. at the spray head. An elongated conductive rod is reciprocably supported within a nozzle of the spray head to create an electrical charge differential between the atomized liquid coating material and the article in the coating zone when charged by a high voltage source. Preferably, the rod is positioned within a liquid discharge orifice of the nozzle to alternatively open and close the nozzle. Also, preferably, the air flow rate at the spray head is in the range of 5–35 CFM, and the air delivery pressure at the spray head is in the range of three to nine psi over atmospheric pressure.

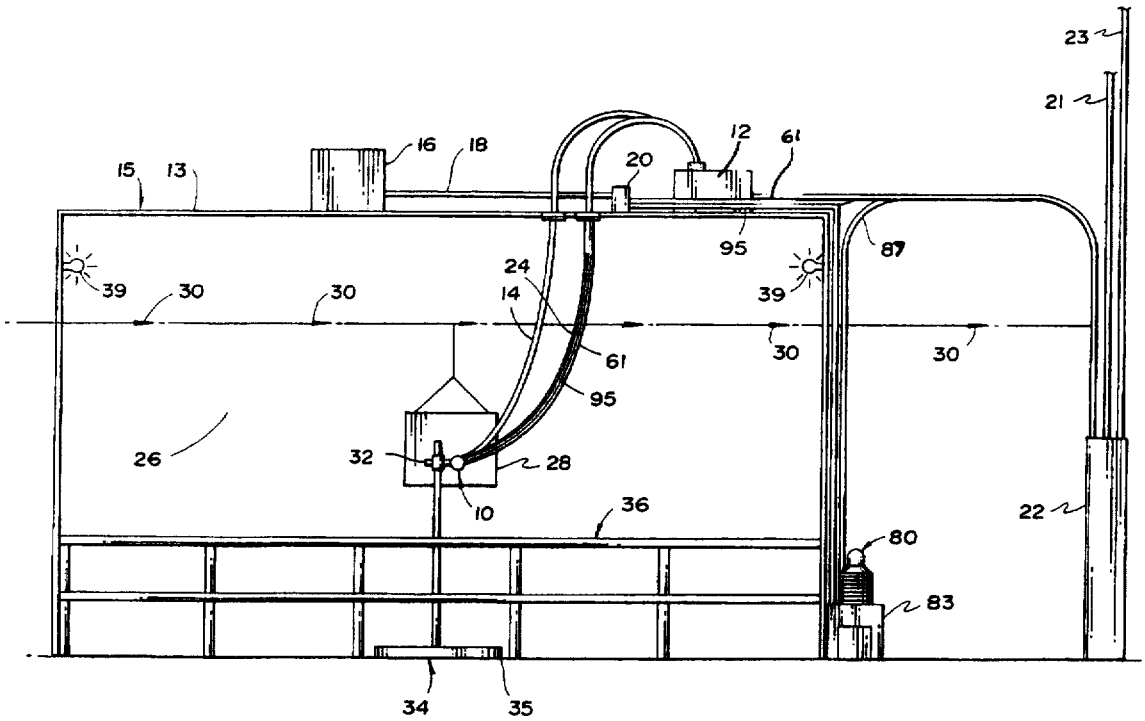

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 9 and 10 is confirmed.

Claims 1–8 and 11–21 are cancelled.

* * * * *